US005676591A

United States Patent [19]

Huang

[11] Patent Number: 5,676,591

[45] Date of Patent: Oct. 14, 1997

[54] BIT SHARPENER

[76] Inventor: Cheng-hsien Huang, No. 569, Wuchuan S. Rd., South Dist., Taichung, Taiwan

[21] Appl. No.: 698,058

[22] Filed: Aug. 13, 1996

[51] Int. Cl.[6] ..... B24B 27/08

[52] U.S. Cl. ..... 451/359; 451/349; 451/375; 451/549

[58] Field of Search ..... 276/108.6, 82; 30/457; 451/359, 375, 549, 282, 293, 48, 349, 451, 454

[56] References Cited

U.S. PATENT DOCUMENTS

| | | | |
|---|---|---|---|
| 3,757,320 | 9/1973 | Wurscher | 451/375 |
| 3,803,771 | 4/1974 | Bunn | 451/549 |
| 4,069,619 | 1/1978 | Escamiila | 451/349 |
| 4,858,389 | 8/1989 | Wurscher | 451/375 |
| 5,210,977 | 5/1993 | Werner | 451/349 |

*Primary Examiner*—Robert A. Rose
*Assistant Examiner*—George Nguyen
*Attorney, Agent, or Firm*—Welsh & Katz, Ltd.

[57] ABSTRACT

A bit sharpener includes a casing with a front plate having a first tube extending therefrom and a rear plate with a plurality of first holes defined therein, the rear plate having a first tubular member and a first rod centrally extending from an inner side thereof such that a guide plate is mounted to the first tubular member and a grinding member is mounted to the guide plate, a rotating member connected to the grinding member and receiving the first rod therein with two springs disposed between the grinding member, the first rod and an inner side of a front end of the rotating member, the front end of the rotating member having a cone-shaped recess defined in a front side thereof for jaws of a hand drill inserted therein to rotate the rotating member and the grinding member such that when a bit is inserted through the first hole and the vent, the bit is ground by the grinding member.

4 Claims, 3 Drawing Sheets

BIT SHARPENER

BACKGROUND OF THE INVENTION

1. Field of the Invention

The present invention relates to a sharpener and more particularly, to a portable bit sharpener.

2. Brief Description of the Prior Art

Hand drills are a popular tool and are used in a variety of fields. Generally, the hand drill can be equipped with a lot of bits such that the hand drill can be suitably used in different situations when cooperated with different bits. The bits will be come blunt after being used for a period of time and a user usually takes the bits to a store where there are grinders or sharpeners to sharpen the bits. Most of the grinders and sharpeners are a fixed device and occupy a lot of space such that people will not buy such a device to take back to their house.

The present invention intends to provide a portable bit sharpener which is driven by the hand drill and is easily operated so as to mitigate and/or obviate the above-mentioned problems.

SUMMARY OF THE INVENTION

The present invention provides a bit sharpener which includes a casing having a front plate with a first tube extending therefrom and a rear plate with a plurality of first holes defined therein. A first tubular member extends frontwardly from an inner side of the rear plate and a first rod centrally extends frontwardly from the inner side of the rear plate.

A guide plate with a plurality of vents defined therein has a central hole defined therein and is mounted to the first tubular member. The guide plate has a disk disposed to a front side thereof, the disk having a first inclined surface defined in a rear periphery thereof.

A grinding-member includes a plate member and a grinding ring disposed to a rear side of the plate member. The grinding ring has a second inclined surface defined in a rear periphery thereof, the plate member having a bottom in which a second hole is defined and a second tubular member extending rearwardly from the bottom such that the first rod extends through the second tubular member and the second hole. The plate member has at least two slots defined therein.

A rotating member has a front end and a rear end which is an open end and a flange extending radially and outwardly from the rear end. Two protrusions extend rearwardly longitudinally from the flange so as to extend through the slots of the grinding member. The front end has a cone-shaped recess defined in a front side thereof and a second rod extending rearwardly from a rear side of the front end. A first spring is received between the plate member and the rear side of the front end of the rotating member, a second spring is received between a distal end of the first rod and the rear side of the front end of the rotating member such that when jaws of a hand drill are inserted in the cone-shaped recess, the rotating member and the grinding member can be rotated by the hand drill to grind a bit extending through the first hole and the vent.

It is an object of the present invention to provide a bit sharpener which is operated by the hand drill.

It is another object of the present invention to provide a portable bit sharpener which is operated easily.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
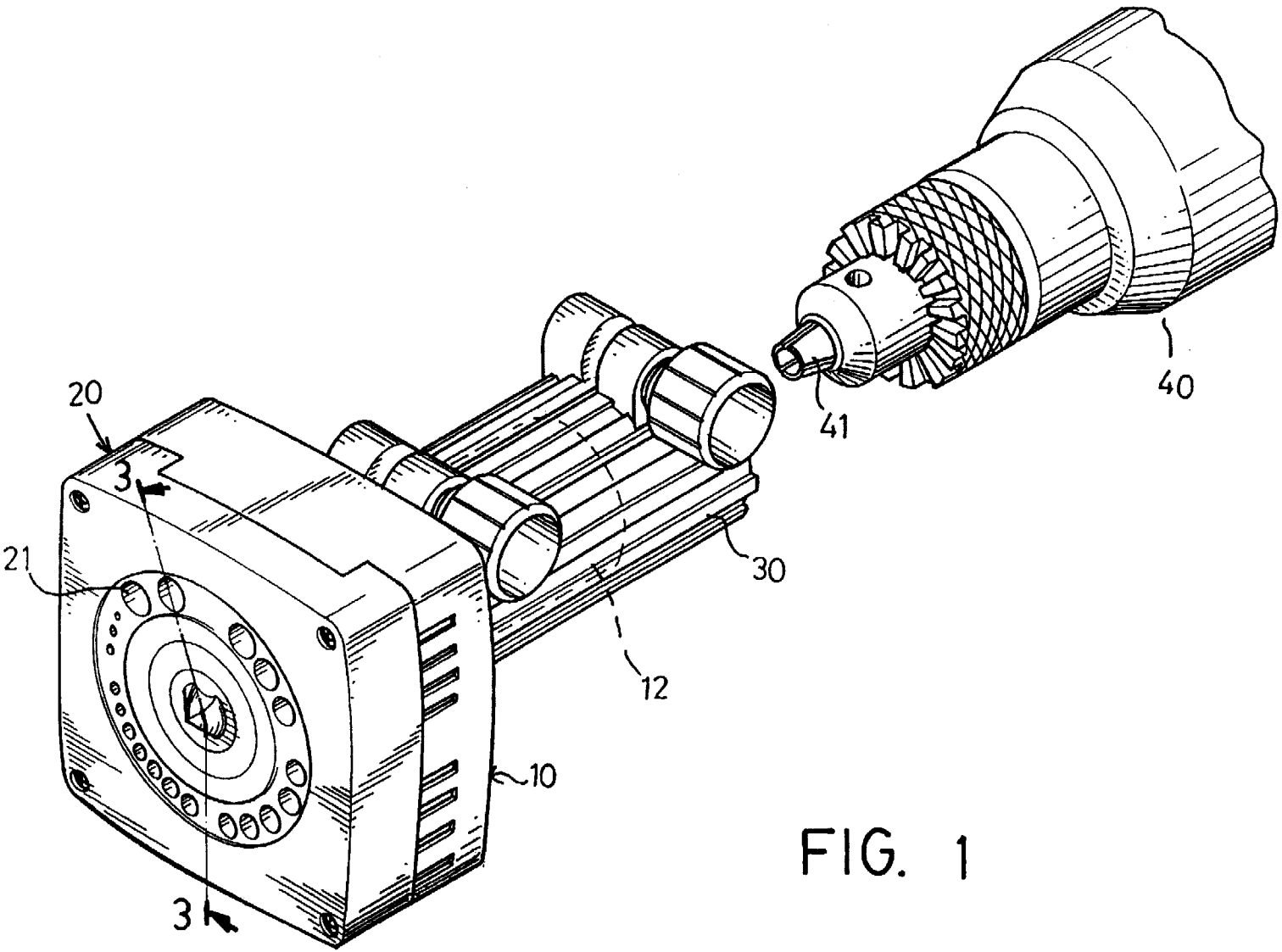
FIG. 1 is an exploded view of a bit sharpener and a hand drill.
Figure 2:
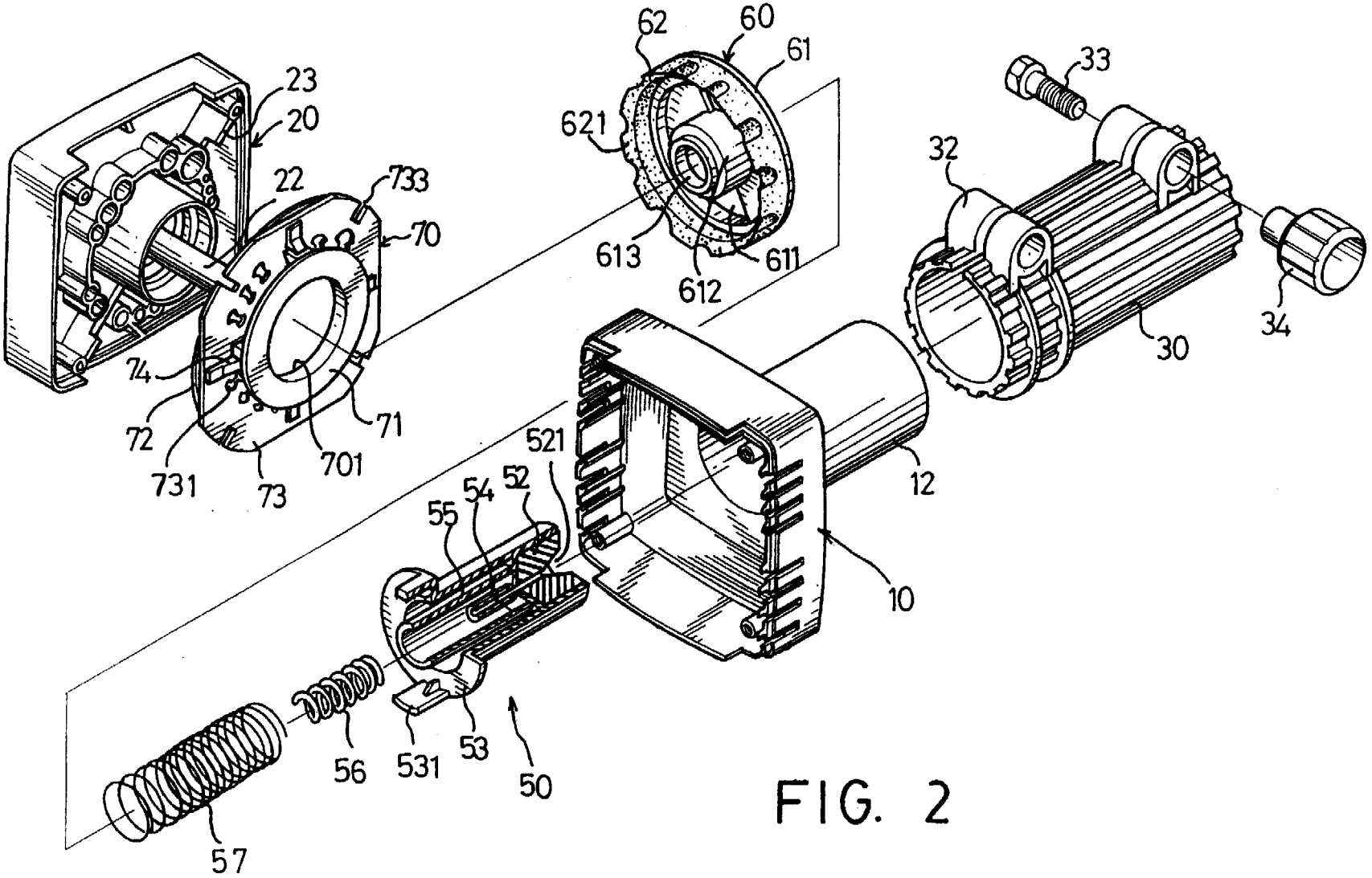
FIG. 2 is an exploded view of the bit sharpener in accordance with the present invention.
Figure 3:
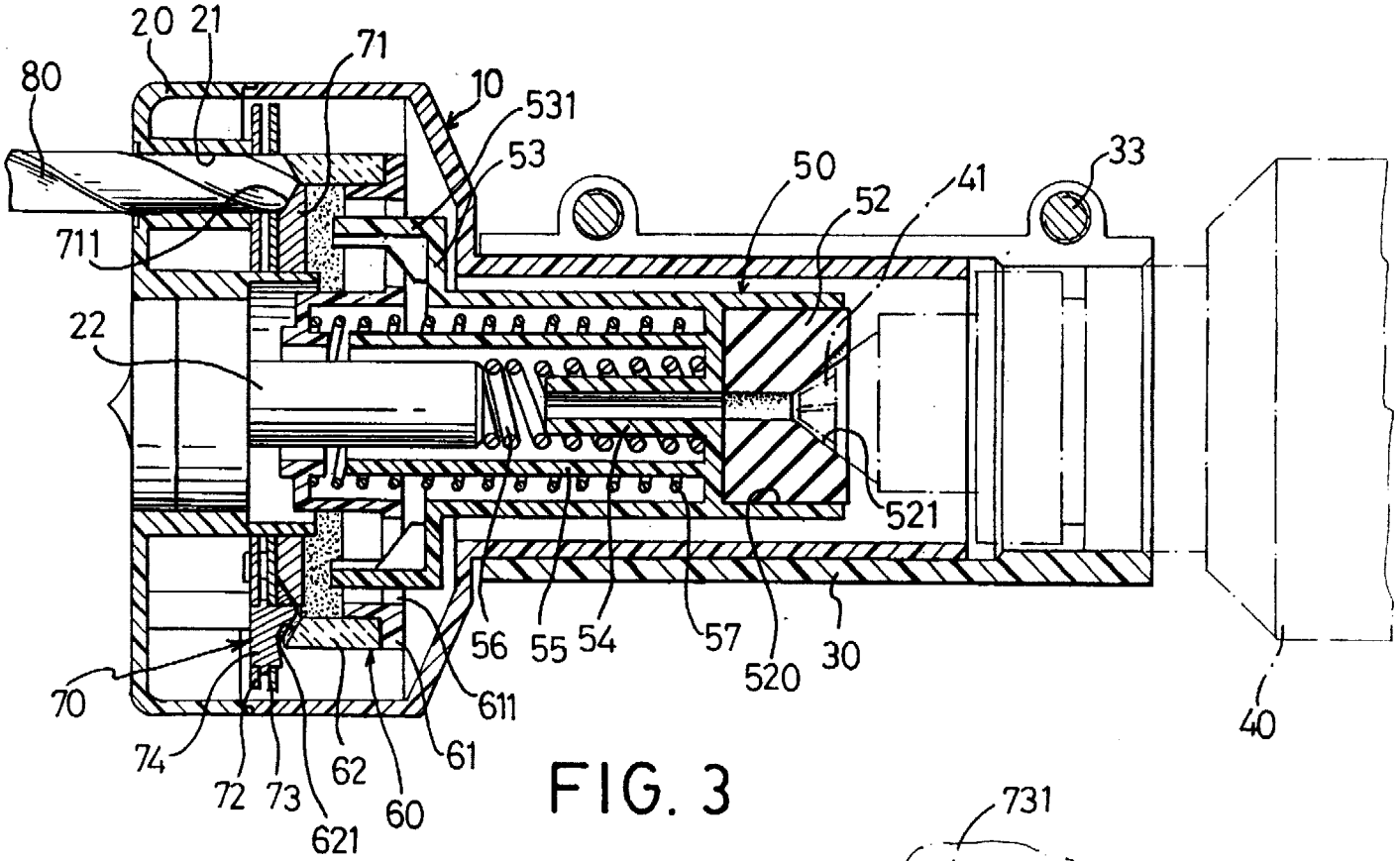
FIG. 3 is a side elevational view, partly in section, of the bit sharpener.

Referring to the drawings and initially to FIGS. 1 through 3, a bit sharpener in accordance with the present invention generally includes a casing composed of a front part 10 and a rear part 20, the front part 10 having a front plate and the rear par% having a rear plate. A first tube 12 extends from the front plate of the front part. The rear plate has a plurality of first holes 21 defined therein. A first tubular member 201 extends frontwardly from an inner side of the rear plate and a first rod 22 centrally extends frontwardly from the inner side of the rear plate and is located in a center of the first tubular member 201.

A guide plate 70 has two plates 72, 73 connected in parallel together by four blocks 74 connected therebetween, a central hole 701 defined in the two plates 72, 73 and the first tubular member 201 extending through the central hole 701. The guide plate 70 has notches 733 defined in four corners thereof so as to each securely receive a respective rib 23 extending from the front side of the rear plate. The guide plate 70 has a plurality of dumbbell-shaped vents 731 defined in the two plates 72, 73 and a disk 71 is disposed to a front side of the plate 73. The disk 71 has a first inclined surface 711 (see FIG. 3) defined in a rear periphery thereof.

A grinding member 60 includes a plate member 61 and a grinding ring 62 disposed to a rear periphery of the plate member 61. The grinding ring 62 has a second inclined surface 621 defined in a rear periphery thereof. The plate member 61 has a second tubular member 612 which extends rearwardly from a rear side thereof and the second tubular member 612 has a second hole 613 defined therein such that the first rod 22 extends through the second tubular member 612 and the second hole 613. The plate member 61 has two slots 611 defined therein.

Figure 4:
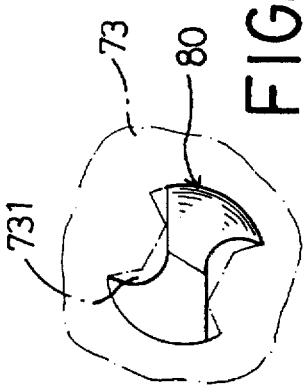
FIG. 4 is an illustrative view to show a bit inserted through a dumbbell-shaped vent of a guide plate.

A rotating member 50 has a front end and a rear end which is an open end and has a flange 53 extending radially therefrom, at with least two protrusions 531 extending rearwardly and longitudinally from the flange 53. The front end of the rotating member 50 has a recess 520 defined therein for a solid body 52 fixedly received therein and the solid body 52 has a cone-shaped recess 521 defined in a front side thereo. A second rod 54 extends rearwardly from a rear side of the solid body 52. A second tube 55 extends rearwardly from the rear side of the solid body 52 such that the second rod 54 is located in the second tube 55. The protrusions 531 extend through the slots 611 of the grinding member 60 and a first spring 57 mounted on the second tube 55 is received between the plate member 61 and the rear side of the solid body 52 of the rotating member 50. A second spring 56 is biased between a distal end of the first rod 22 and the rear side of the solid body 52 of the rotating member 50. The first inclined surface 711 of the disk 71 and the second inclined surface 621 of the grinding ring 62 define an annular cone-shaped groove which is in alignment with the vent 731 corresponding thereto such that when a bit 80 is inserted through the first hole 21 and the vent 731, a tip portion of the bit 80 is received in the cone-shaped groove. Referring to FIG. 4, because each vent 731 is a dumbbell-shaped when the bit 80 is inserted therethrough, the tip portion of the bit 80 is limited thereby and therefore can be positioned.

Each one of the blocks 74 has a third inclined surface which has a slope the same as that of the second inclined surface 621 of the grinding ring 62.

A sleeve 30 has a C-shaped configuration and can be securely clamped to the first tube 12 by threadedly engaging two bolts 33 (only is shown in FIG. 2) to a respective nut 34 via respective tubular elements 32 disposed to each one of two end sides of the sleeve 30. As can be seen in FIG. 3, a front portion of the hand drill 40 can be inserted into the sleeve 30 and jaws 41 of the hand drill 40 are received in the cone-shaped recess 521. When the hand drill 40 is operated and pushed toward the rotating member 50, the rotating member 50 together with the grinding member 60 are rotated and the tip portion of the bit 80 is sharpened by the grinding ring 62. The third inclined surfaces of the blocks 74 guide the grinding ring 62 to be rotated in a desired plane.

Although the invention has been explained in relation to its preferred embodiment, it is to be understood that many other possible modifications and variations can be made without departing from the spirit and scope of the invention as hereinafter claimed.

What is claimed is:

1. A bit sharpener comprising:

a casing having a front plate and a rear plate, a first tube extending frontwardly from said front plate and said rear plate having a plurality of first holes defined therein, a first tubular member extending frontwardly from an inner side of said rear plate and a first rod centrally extending frontwardly from said inner side of said rear plate;

a guide plate having a central hole defined therein and securely mounted to said first tubular member, said guide plate having a plurality of vents defined therein and having a disk disposed to a front side thereof, each of said vents defined by a dumbbell-shaped inner periphery and said disk having a first inclined surface defined in a rear periphery thereof;

a grinding member including a plate member and a grinding ring disposed to a rear periphery of said plate member, said grinding ring having a second inclined surface defined in a rear periphery thereof, said plate member having a second tubular member extending rearwardly from a rear side thereof and the second tubular member having a second hole defined therein such that said first rod extends through said second tubular member and said second hole, said plate member having two slots defined therein;

a rotating member having a front end and a rear end which is an open end and has a flange extending radially therefrom, at least two protrusions extending rearwardly longitudinally from said flange, said front end having a cone-shaped recess defined in a front side thereof and a second rod extending rearwardly from a rear side of said front end, said protrusions extending through said slots of said grinding member and a first spring received between said plate member and said rear side of said front end of said rotating member, a second spring received between a distal end of said first rod and said rear side of said front end of said rotating member, and a sleeve mounted to said first tube.

2. The sharpener as claimed in claim 1 wherein each one of said vents is defined by a dumbbell-shaped inner periphery.

3. The sharpener as claimed in claim 1 further comprising a sleeve mounted to said first tube.

4. The sharpener as claimed in claim 1 wherein said guide plate has at least one block extending towardly from said front side thereof and said block having a third inclined surface which has a slope the same as that of said second inclined surface of said grinding ring.

* * * * *